US009460692B2

(12) United States Patent
Chen et al.

(10) Patent No.: US 9,460,692 B2
(45) Date of Patent: Oct. 4, 2016

(54) DRUM PEDAL AND DRUM PEDAL UNIT

(71) Applicant: RELIANCE INTERNATIONAL CORP., Taipei (TW)

(72) Inventors: Chih-Yung Chen, Taipei (TW); Cheng-Lin Ho, Taipei (TW); Chi-Hua Chuang, Taipei (TW); Wei-Ting Chen, Taipei (TW)

(73) Assignee: Reliance International Corp., Taipei (TW)

( * ) Notice: Subject to any disclaimer, the term of this patent is extended or adjusted under 35 U.S.C. 154(b) by 0 days.

(21) Appl. No.: 14/856,133

(22) Filed: Sep. 16, 2015

(65) Prior Publication Data

US 2016/0196809 A1 Jul. 7, 2016

(30) Foreign Application Priority Data

Oct. 23, 2014 (TW) ..... 103136717 A

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS

| | | | | |
|---|---|---|---|---|
| 2,784,635 | A * | 3/1957 | Troppe | G10D 13/006 84/422.1 |
| 4,198,894 | A * | 4/1980 | Della-Porta | G10D 13/006 84/422.1 |
| 6,271,450 | B1 * | 8/2001 | Mackie | G10D 13/006 84/422.1 |
| 6,762,354 | B2 * | 7/2004 | Cocca | G10D 13/006 84/422.1 |
| 8,487,171 | B2 * | 7/2013 | Groerzinger | G10D 13/006 84/422.1 |
| 2006/0060062 | A1 * | 3/2006 | Dyk | G10D 13/065 84/422.1 |
| 2009/0235806 | A1 * | 9/2009 | Chen | G10D 13/006 84/422.1 |

* cited by examiner

*Primary Examiner* — Robert W Horn
(74) *Attorney, Agent, or Firm* — Lynette Wylie; Apex Juris, pllc

(57) ABSTRACT

A drum pedal has a base, a pivoting assembly, a rotating element, a beater holder assembly, a chain assembly, and a foot board. The pivoting assembly is mounted in the base. The rotating element, the beater holder assembly and the chain assembly are mounted in the pivoting assembly. The foot board is mounted between the chain assembly and the base. The base has a resilient element mounted concentric with a shaft of the pivoting assembly. A rotating element receives the resilient element. A torque of the resilient element is evenly matched with a swing caused by the beater holder and the chain assembly. Therefore, the beater holder and the chain assembly return to the original position immediately after the swing. Two drum pedals are manipulated to play respectively, and are connected by a coupling assembly to compose a drum pedal unit.

6 Claims, 9 Drawing Sheets

DRUM PEDAL AND DRUM PEDAL UNIT

BACKGROUND OF THE INVENTION

1. Field of the Invention

The present invention relates to a drum pedal and a drum pedal unit, and more particularly to a return mechanism of the drum pedal and the drum pedal unit.

2. Description of the Related Art

A drum pedal is a musical instrument. A user tramples on the drum pedal to beat a drum with his or her foot. When a drummer plays a tom-tom drum, a snare drum and a cymbal with his or her hands, the drummer still plays a bass drum at the same time with the drum pedal.

With reference to FIG. 8, a conventional drum pedal 80 has a main base 81, two brackets 82, two assembling parts 83, a pivot 84, a holding base 85, a beater holder 86, an attaching element 87, a tension spring 88 and a foot board 89. The brackets 82 protrude from the main base 81 and are spaced apart at an interval. One of the two brackets 82 has a mounting part 821. The assembling part 83 is formed in one of two ends of the bracket 82 and is located away from the main base 81. The assembling part 83 has a hole defined in a center of the assembling part 83. The pivot 84 is installed through and stands out of the hole of the assembling part 83. The holding base 85 is mounted on an outer wall of the pivot 84 and has a chain 851 connected to the holding base 85. The beater holder 86 is mounted on the outer wall of the pivot 84 and has a beater 861 mounted in the beater holder 86. The attaching element 87 is mounted in one of two ends of the pivot 84. The attaching element 87 is mounted in one of two ends of the tension spring 88. The tension spring 88 has an adjusting element 881, and the other end of the tension spring 88 is connected to the mounting part 821 of the bracket 82 by the adjusting element 881. One of two ends of the foot board 89 is connected to the other end of the chain 851, and the other end of the foot board 89 is mounted rotatably in the main base 81.

With reference FIG. 9, when a drummer tramples on the foot board 89, the chain 851 is driven to rotate the pivot 84. Thereby, the beater holder 86 rotates with the pivot 84, and the beater 861 beats a bass drum. The rotating pivot 84 pivots the attaching element 87 to stretch the tension spring 88, and the tension spring 88 stops a rotation of the pivot 84. Hence, the pivot 84 and the beater 861 return to an original position for a next trampling from the drummer. As the attaching element 87 rotates with the pivot 84, the tension spring 88 does a pendulum motion affected by the attaching element 87. However, a direction of the pendulum motion violates a principle of linear movement of the tension spring 88. Then, the pivot 84 and the beater 861 cannot return to the original position in a minimum time. So the pendulum motion of the tension spring 88 is a low efficiency motion. The user's trampling cannot match up the returning of the beater 861 in tempo. Then the user is laborious in operation and wastes the trampling forces, and a touching feel between the foot and the foot board 89 is in-sensitive. As the user tramples on the foot board 89, the trampling force cannot be transmitted directly and completely to the beater 861 for beating the bass drum.

SUMMARY OF THE INVENTION

An objective of the present invention is to provide a drum pedal and a drum pedal unit. A user operates the drum pedal easily and tramples on a pedal with keen sensitivity. A trampling force can be transmitted directly and completely to the beater by the foot board. The user manipulates two beaters of two drum pedals to beat the drum respectively.

To achieve the foregoing objective, the drum pedal in accordance with the present invention comprises a base, a pivoting assembly, a rotating element, a beater holder assembly, a chain assembly, and a foot board. The base has a main plate, two brackets, and a mounting assembly. The brackets protrude from the main plate. One of the two brackets has an assembling part. The assembling part is formed on the bracket and is located away from the main plate. The mounting assembly is mounted on the other bracket and is located away from the main plate. The mounting assembly has a supporting part, a cap, an adjusting knob, an abutting element, and a resilient element. The supporting part has a recess defined in the supporting part and a guiding groove defined in the recess longitudinally. The cap covers the recess and is mounted in the supporting part. The cap has a slot defined through the cap longitudinally and a notch defined in the cap laterally. The adjusting knob is mounted inside the supporting part and the cap and has a mounting tube that is mounted through the supporting part and the cap. The mounting tube has an outer thread that is formed in an outer surface of the mounting tube. The abutting element is mounted inside the supporting part and the cap, is mounted around the mounting tube, and is capable of moving along the mounting tube. The mounting tube has a mounting hole, a guiding part, and a restricted element. The mounting hole receives the mounting tube and has an inner thread that is formed in an inner surface of the mounting hole and is engaged with the outer thread of the mounting tube. The guiding part protrudes from an outer surface of the abutting element, and is mounted slidably in the guiding groove. The restricted element is mounted in the abutting element, and extends slidably out of the slot. The resilient element is mounted inside the recess. One of two ends of the resilient element is mounted on the abutting element, and the other end of the resilient element extends out of the notch. The pivoting assembly is mounted between the assembling part and the mounting assembly. The rotating element, the beater holder assembly and the chain assembly are mounted on the pivoting assembly. The other end of the resilient element is mounted in the rotating element. One of two ends of the foot board is mounted in the chain assembly, and the other end of the foot board is mounted rotatably in the main plate.

Other objectives, advantages and novel features of the invention will become more apparent from the following detailed description when taken in conjunction with the accompanying drawings.

DETAILED DESCRIPTION OF THE INVENTION

Figure 1:
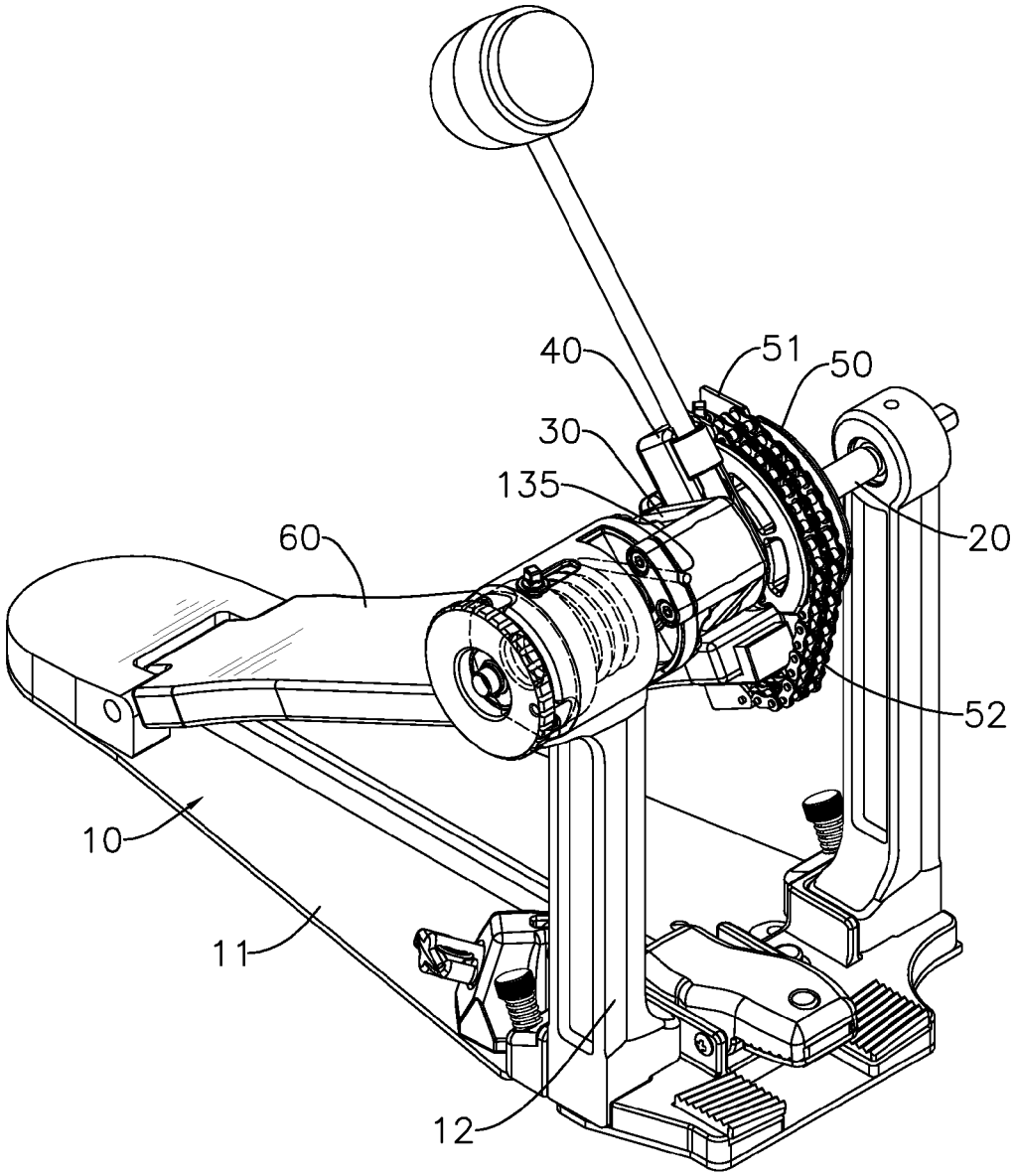
FIG. 1 is a perspective view of a drum pedal in accordance with the present invention.

With reference to FIG. 1, a drum pedal in accordance with the present application has a base 10, a pivoting assembly 20, a rotating element 30, a beater holder assembly 40, a chain assembly 50, and a foot board 60.

Figure 2:
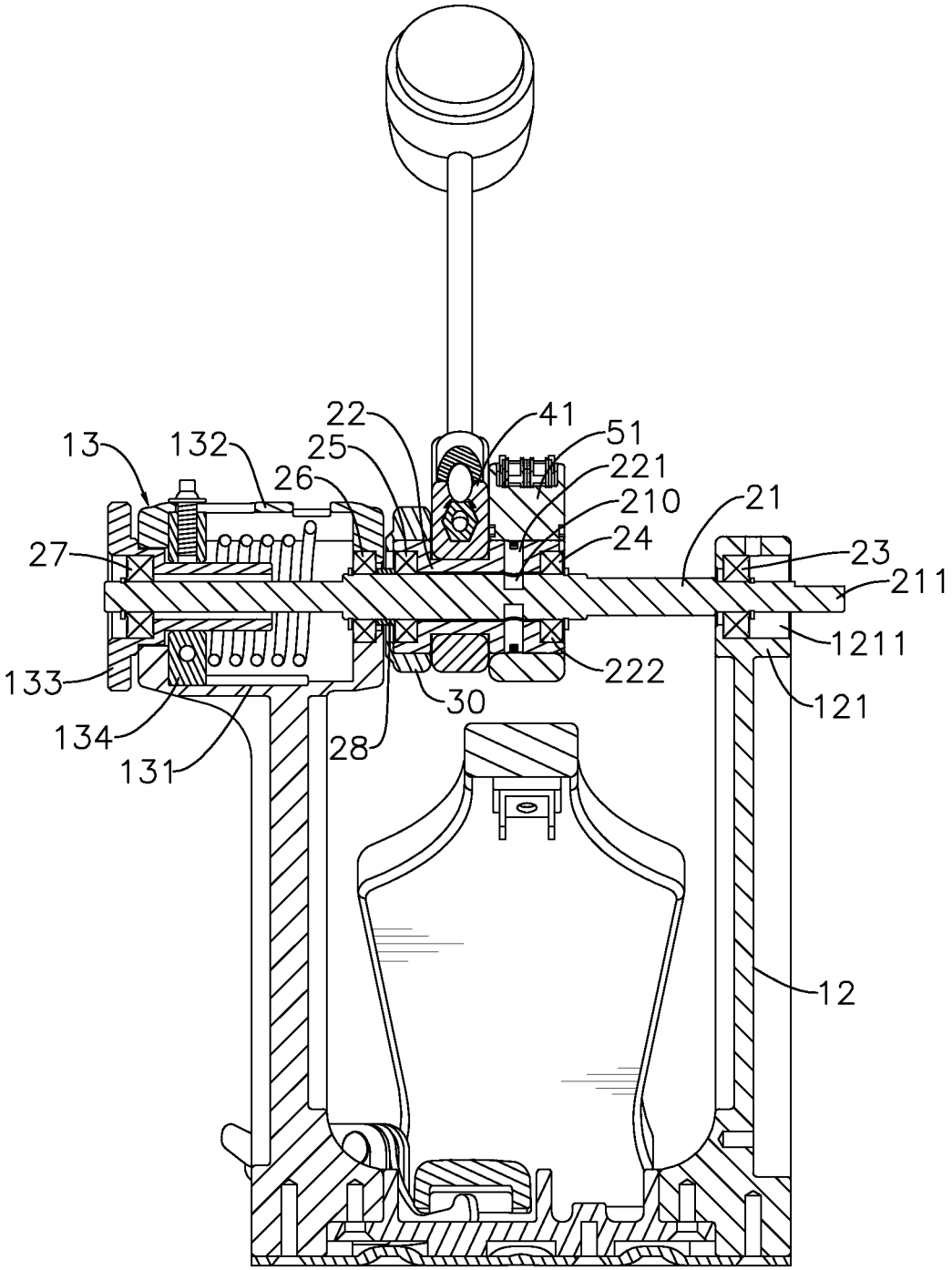
FIG. 2 is a rear view in partial section of the drum pedal in FIG. 1.

With reference to FIGS. 1 and 2, the base 10 has a main plate 11, two brackets 12, and a mounting assembly 13.

The brackets 12 protrude respectively from the main plate 11 and are spaced apart at an interval.

One of the two brackets 12 has an assembling part 121. The assembling part 121 is formed on the bracket 12 and is located away from the main plate 11. The assembling part 121 has a first accommodating part 1211 that is defined in the assembling part 121.

The mounting assembly 13 is mounted on the other bracket 12 and is located away from the main plate 11, as shown in FIG. 2.

Figure 3:
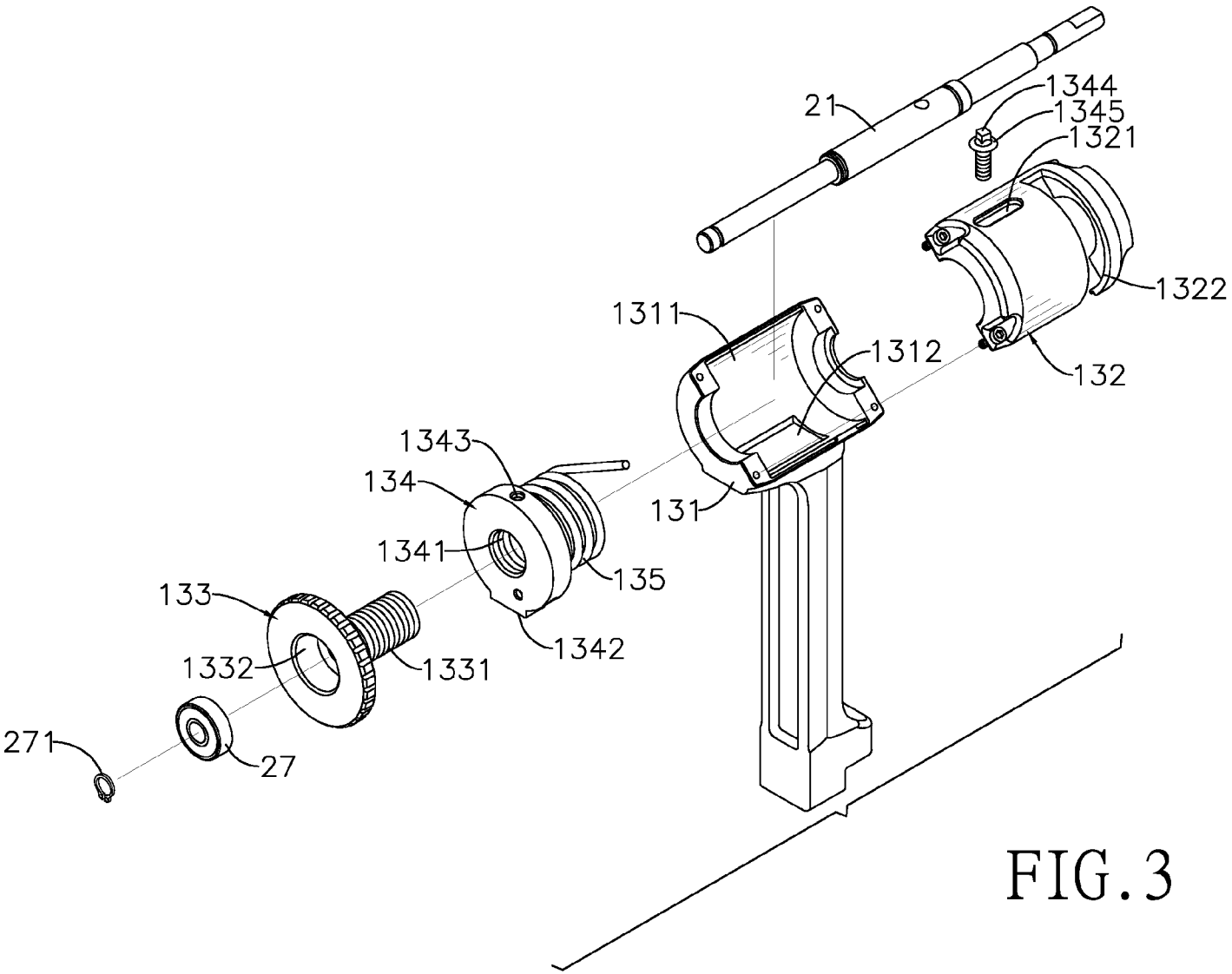
FIG. 3 is an exploded perspective view of a mounting assembly of the drum pedal in FIG. 1.

With reference to FIGS. 2 and 3, the mounting assembly 13 has a supporting part 131, a cap 132, an adjusting knob 133, an abutting element 134 and a resilient element 135.

The supporting part 131 has a recess 1311 and a guiding groove 1312.

The recess 1311 is defined in the supporting part 131. The guiding groove 1312 is defined in the recess 1311 longitudinally.

The cap 132 covers the recess 1311, is mounted in the supporting part 131, and has a slot 1321 and a notch 1322.

The slot 1321 is defined through the cap 132 longitudinally. The notch 1322 is defined in the cap 132 laterally.

The adjusting knob 133 is mounted in the supporting part 131 and the cap 132, and has a mounting tube 1331 and a second accommodating part 1332.

The mounting tube 1331 is hollow, is formed on and protrudes axially from the adjusting knob 133, and is mounted through the supporting part 131 and the cap 132. The mounting tube 1331 protrudes from one of two end surfaces of the adjusting knob 133, and has an outer thread that is formed in an outer surface of the mounting tube 1331.

The second accommodating part 1332 is defined in the other end surface of the adjusting knob 133, and communicates with the mounting tube 1331.

The abutting element 134 is mounted inside the supporting part 131 and the cap 132, is mounted around the mounting tube 1331, and is capable of moving along the mounting tube 1331. The abutting element 134 has a mounting hole 1341, a guiding part 1342, an attaching hole 1343, and a restricted element 1344.

The mounting hole 1341 is defined in a center of the abutting element 134, receives the mounting tube 1331, and has an inner thread that is formed in an inner surface of the mounting hole 1341 and is engaged with the outer thread of the mounting tube 1331.

The guiding part 1342 is mounted slidably in the guiding groove 1312, and protrudes from an outer surface of the abutting element 134.

The attaching hole 1343 is defined in the abutting element 134.

The restricted element 1344 is mounted in the attaching hole 1343, extends slidably out of the slot 1321, and has a flange 1345 that is formed annularly on an outer surface of the restricted element 1344. The flange 1345 abuts an outer surface of the cap 132.

The resilient element 135 is mounted inside the recess 1311. One of two ends of the resilient element 135 is mounted on the abutting element 134, and the other end of the resilient element 135 extends out of the notch 1322. Specifically, the resilient element 135 is a torsion spring.

Figure 4:
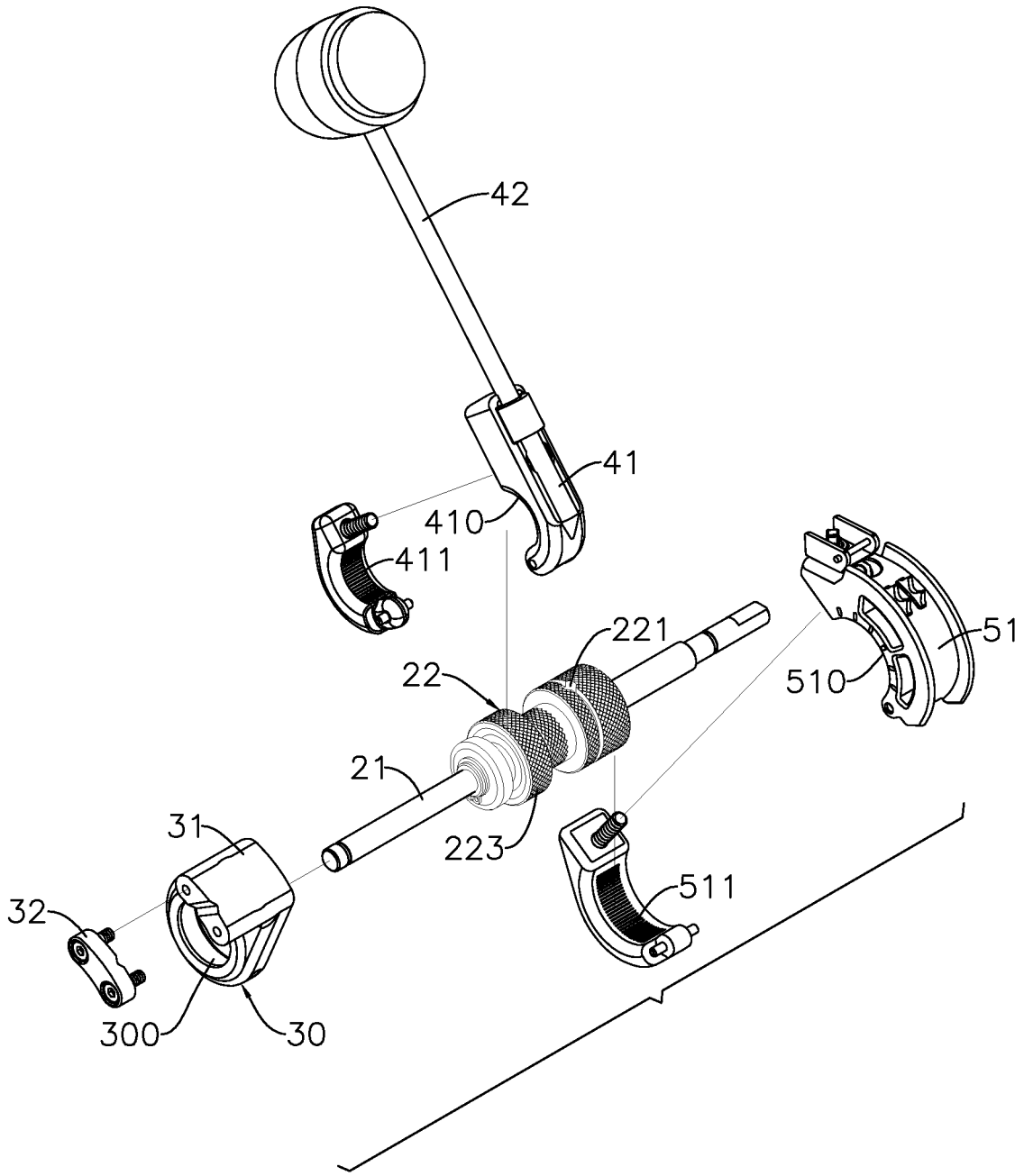
FIG. 4 is an exploded perspective view of a rotating element, a beater holder assembly, and a chain assembly of the drum pedal in FIG. 1.

With reference to FIGS. 2 to 4, the pivoting assembly 20 is mounted between the assembling part 121 and the mounting assembly 13, and has a shaft 21, a sleeve 22, a first bearing 23, a second bearing 24, a third bearing 25, a fourth bearing 26, a fifth bearing 27, and a retaining ring 28.

The shaft 21 is mounted through the assembling part 121 and the mounting assembly 13, and has an attaching part 211 and two connecting recesses 210.

The attaching part 211 extends out of the assembling part 121, and is formed in one of two ends of the shaft 21.

The connecting recesses 210 are defined radially in an outer wall of the shaft 21, and are spaced apart at an interval.

The sleeve 22 is mounted rotatably on the outer wall of the shaft 21, and has two connecting holes 221, two mounting grooves 222, and an embossed part 223.

The connecting holes 221 are radially defined in an outer surface of the sleeve 22, and correspond to the connecting recesses 210 respectively.

The mounting grooves 222 are defined respectively in two end surfaces of the sleeve 22.

The embossed part 223 is formed in the outer surface of the sleeve 22.

The first bearing 23 is mounted inside the first accommodating part 1211, and receives the attaching part 211 of the shaft 21.

The second bearing 24 is mounted inside one of the two mounting grooves 222, and receives the shaft 21.

The third bearing 25 is mounted inside the other mounting groove 222, and receives the shaft 21.

The fourth bearing 26 is mounted between the supporting part 131 and the cap 132, corresponds to the third bearing 25 axially, and receives the shaft 21.

The fifth bearing 27 is mounted inside the second accommodating part 1332, and receives the shaft 21.

The retaining ring 28 receives the shaft 21, is mounted between the third bearing 25 and the fourth bearing 26, and abuts the third bearing 25 and the fourth bearing 26 respectively. Specifically, the above-mentioned bearings are mounted firmly on the shaft 21 by a C-ring 271. For example, the fifth bearing 27 is abutted by the C-ring 271 that is mounted on the shaft 21, as shown in FIGS. 2 and 3.

With reference to FIGS. 1, 2 and 4, the rotating element 30 is mounted on the outer surface of the sleeve 22, receives the other end of the resilient element 135, and has a through hole 300, a clamping part 31, and a combining element 32.

The through hole 300 is defined through the rotating element 30, and receives the sleeve 22.

The clamping part 31 protrudes from the rotating element 30.

The combining element 32 is mounted on the clamping part 31, and abuts the other end of the resilient element 135.

With reference to FIGS. 2 and 4, the beater holder assembly 40 is mounted on the outer surface of the sleeve 22, and has a beater holder 41 and a beater 42.

The beater holder 41 is mounted on the outer surface of the sleeve 22, and has a first assembling hole 410 and a first rough surface 411.

The first assembling hole 410 is defined axially through the beater holder 41.

The first rough surface 411 is formed inside the first assembling hole 410, and abuts the embossed part 223.

The beater 42 is mounted in the beater holder 41.

With reference to FIGS. 1, 2, and 4, the chain assembly 50 is mounted on the outer surface of the sleeve 22, and has a holding base 51 and a chain 52.

The holding base 51 is mounted on the outer surface of the sleeve 22, and has a second assembling hole 510 and a second rough surface 511.

The second assembling hole 510 is defined axially through the holding base 51.

The second rough surface 511 is formed inside the second assembling hole 510, and abuts the embossed part 223.

One of two ends of the chain 52 is mounted in the holding base 51.

The foot board 60 is an elongate plate. One of two ends of the foot board 60 is rotatably mounted on the main plate 11, and the other end of the foot board 60 is mounted in the other end of the chain 52.

Figure 5:
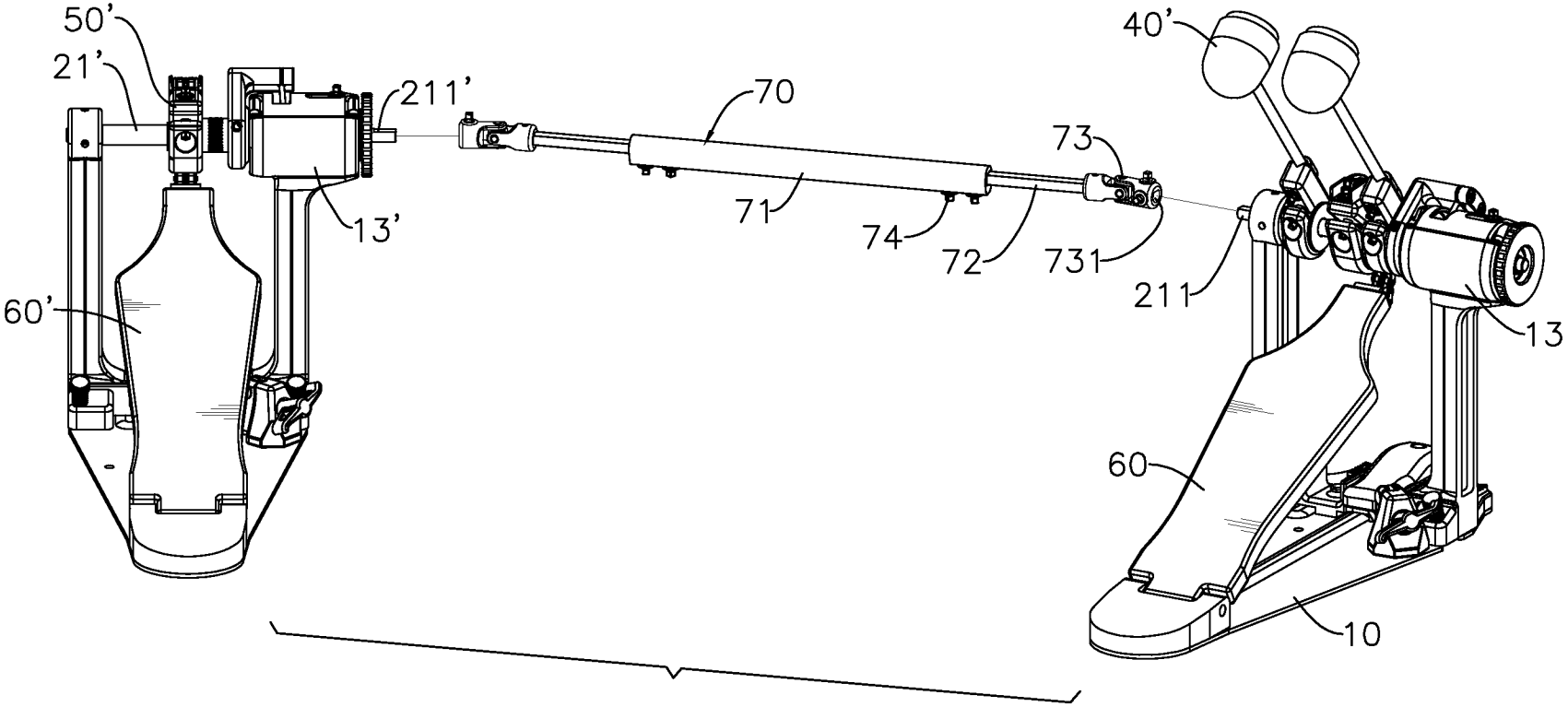
FIG. 5 is a perspective view of a drum pedal unit in accordance with the present invention.

With reference to FIG. 5, a drum pedal unit comprises two drum pedals of the present invention and a coupling assembly 70.

Figure 6:
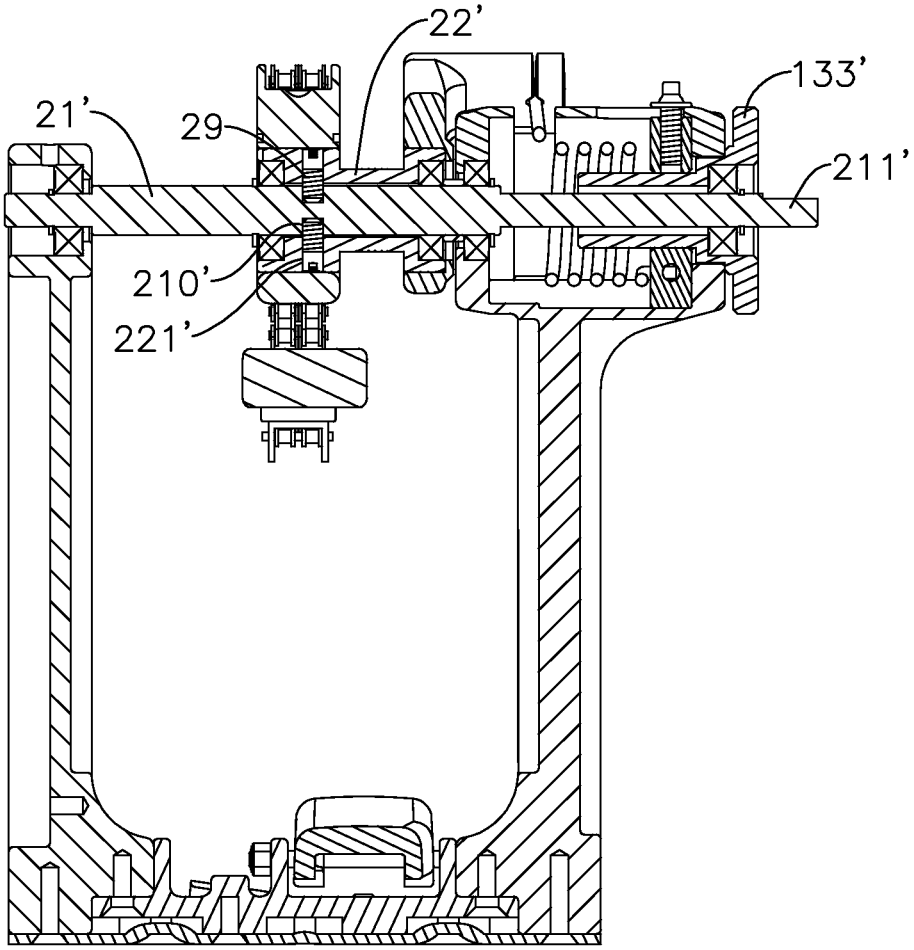
FIG. 6 is an exploded perspective view of a beater holder assembly of one of two drum pedals of the drum pedal unit in FIG. 5.
Figure 7:
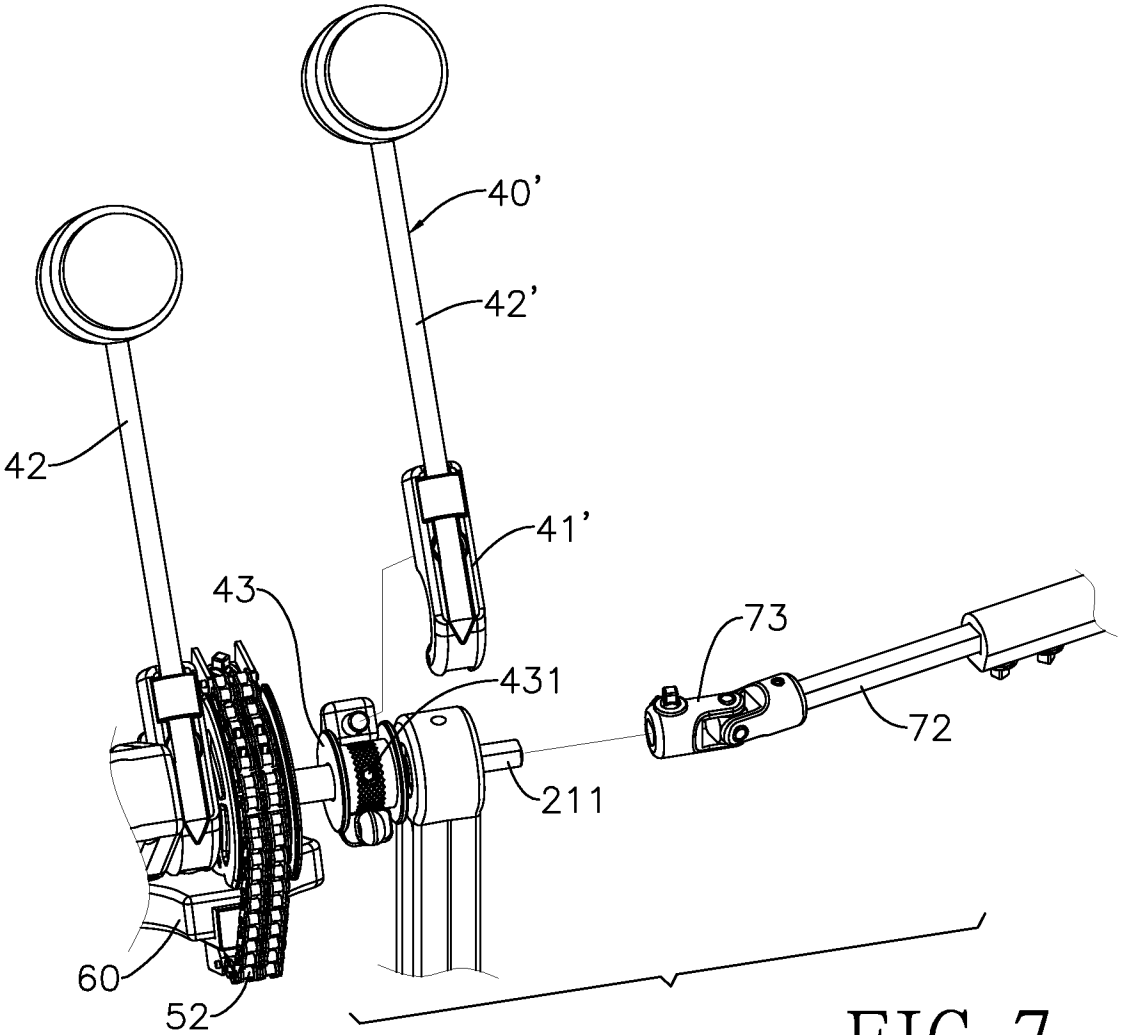
FIG. 7 is an enlarged rear view in partial section of the other drum pedal of the drum pedal unit in FIG. 5.
Figure 8:
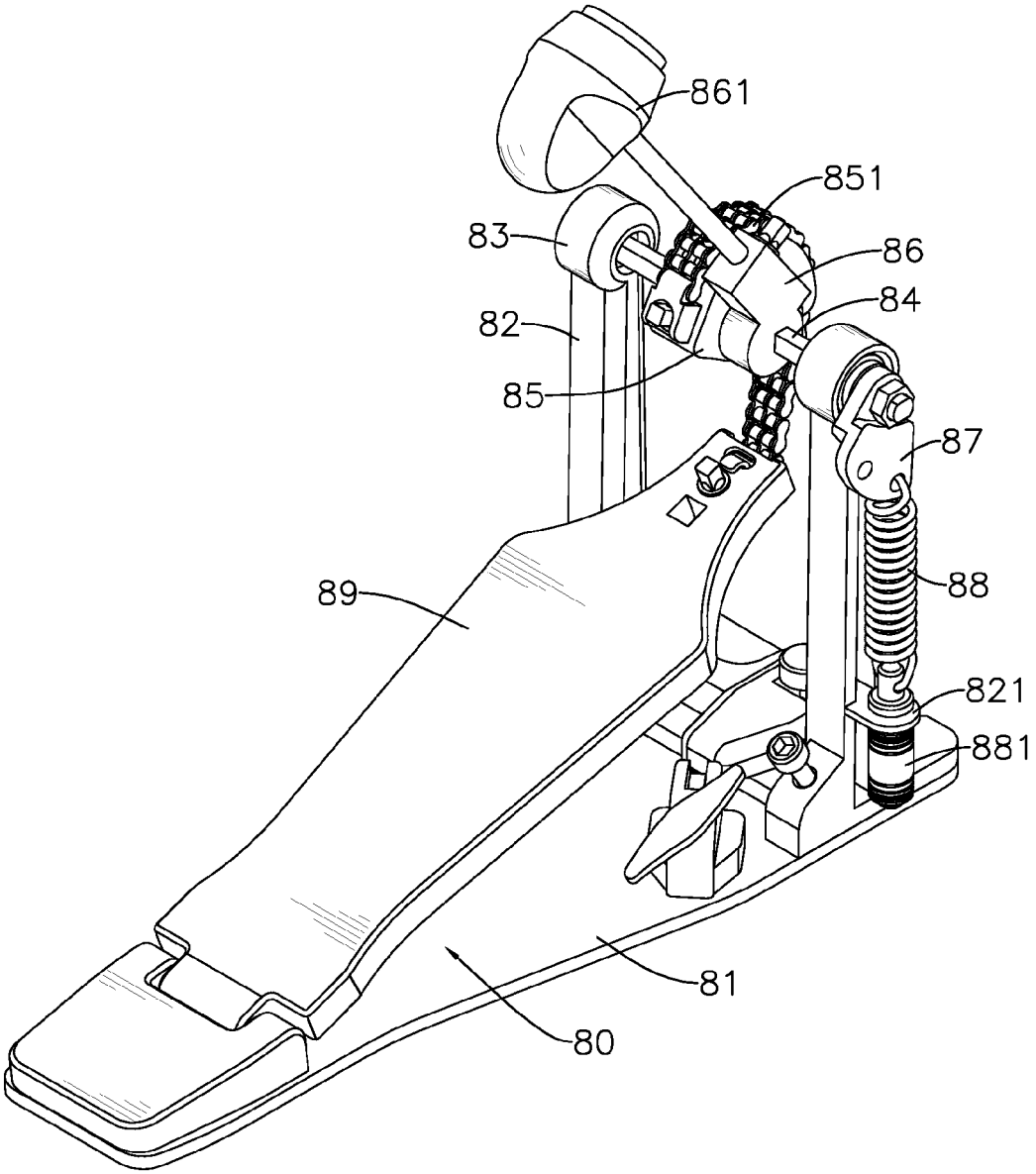
FIG.8 PRIOR ART
FIG. 8 is a perspective view of a conventional drum pedal in accordance with the prior art.
Figure 9:
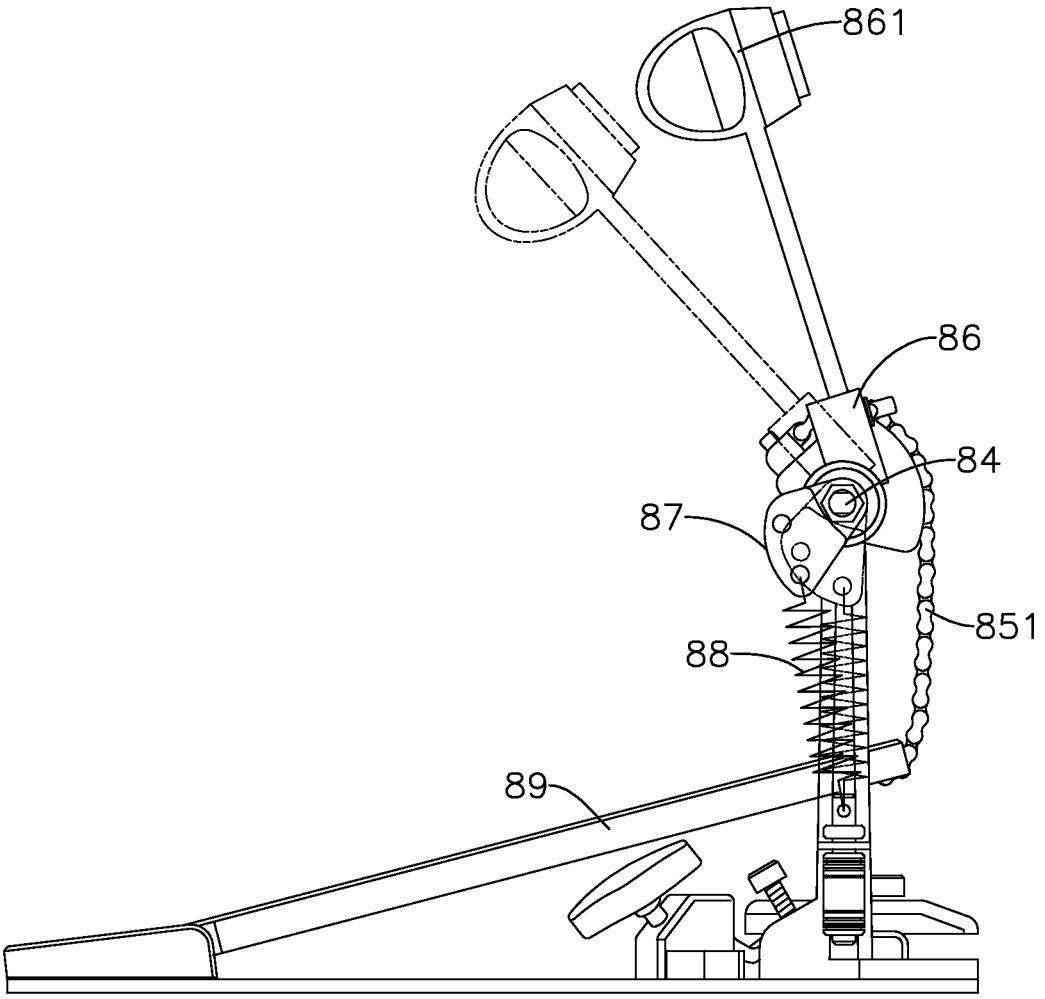
FIG.9 PRIOR ART
FIG. 9 is a side view of the conventional drum pedal in FIG. 8.

With reference to FIGS. 6 and 7, one of the drum pedals has two connecting elements 29 and a minor sleeve 43.

Each connecting element 29 is mounted in the connecting hole 221' of the sleeve 22' and the connecting recess 210' of the shaft 21', making the sleeve 22' mounted firmly in the shaft 21'.

The attaching part 211' of the shaft 21' extends out of the adjusting knob 133'.

The minor sleeve 43 is mounted firmly on the outer surface of the shaft 21 of the other drum pedal, and has multiple first fastening elements 431 that are mounted through the minor sleeve 43 and abut the shaft 21.

The beater holder assembly 40' of the drum pedal that has the connecting elements 29 is mounted on an outer surface of the minor sleeve 43.

With reference to FIGS. 5 and 7, the coupling assembly 70 connects the drum pedals, and has a connecting sleeve 71, two sticks 72, and two universal joints 73.

The connecting sleeve 71 is hollow.

The sticks 72 are mounted in two ends of the connecting sleeve 71.

Each universal joint 73 is mounted in the stick 72, and has an attaching recess 731 that is defined in the universal joint 73. Specifically, the universal joints 73 are located at two ends of the coupling assembly 70.

The attaching recess 731 receives the attaching part 211, 211' of the shaft 21, 21' of the drum pedal.

When a user tramples on the foot board 60, the foot board 60 drives the holding base 51 and the chain 52. Then, the holding base 51 drives the sleeve 22 to rotate relative to the shaft 21, and the rotating element 30 and the beater holder 41 rotate at the same time. Because of a rotation of the beater holder 41, the beater 42 beats a drum. The rotating element 30 twists the resilient element 135. The resilient element 135 affected by the rotating element 30 provides a responsive torque. When an external driving force of the sleeve 22 is removed, the torque of the resilient element 135 drives the beater holder assembly 40 and the chain assembly 50 to return to the original position in a short time. The responsive torque of the resilient element 135 is evenly matched with the torque of the beater holder assembly 40 and the chain assembly 50 in a different direction. Therefore, the rotation of the sleeve 22 is stopped effectively. Then, the user tramples on the foot board 60 again easily and quickly.

The torque of the resilient element 135 is adjustable. When the user manipulates the adjusting knob 133, the adjusting knob 133 drives the abutting element 134 to move towards or away from the resilient element 135. Then, the abutting element 134 compresses or releases the resilient element 135. Therefore, a spring constant of the resilient element 135 is adjusted. Thereby, a deformation of the resilient element 135 is changed. The responsive torque of the resilient element 135 is adjustable according to the user's requirement. Then, a damping of the resilient element 135 that stops a rotation is adjustable, and a touching feel between the user's foot and the foot board 60 is changed.

The guiding part 1342 of the abutting element 134 is mounted slidably in the guiding groove 1312, and the restricted element 1344 extends slidably out of the slot 1321. Therefore, the abutting element 134 moves axially and stably inside the supporting part 131 and the cap 132.

The second bearing 24 and the third bearing 25 are mounted in both ends of the sleeve 22 respectively. The second bearing 24 is mounted firmly in the shaft 21 in an axial direction by a C-ring. The third bearing 25 is mounted firmly in the shaft 21 in an axial direction by the retaining ring 28. Thereby, the sleeve 22 is mounted in the outer wall of the shaft 21 firmly in an axial direction.

When the user tramples on the foot board 60 of one drum pedal to drive the beater 42 by his or her right foot, the foot board 60' of the other drum pedal is trampled on by the user's left foot.

Because the sleeve 22' is mounted on the shaft 21' firmly by the connecting element 29, as shown in FIG. 6, the chain assembly 50' drives the sleeve 22' and the shaft 21' to rotate simultaneously. Then the shaft 21' connects the shaft 21 to drive the beater 42' with the coupling assembly 70. The shaft 21 is mounted through the sleeve 22, and as shown in FIG. 2, the shaft 21 rotates relative to the sleeve 22. Thus, the beater 42 and the beater 42' are driven to beat the drum respectively by the user's feet.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A drum pedal comprising:

a base having a main plate;

two brackets protruding from the main plate and spaced apart at an interval, wherein one of the two brackets has an assembling part formed on the bracket and located away from the main plate; and a mounting assembly mounted on the other bracket, located away from the main plate, and having a supporting part having a recess defined in the supporting part; and a guiding groove defined in the recess longitudinally;

a cap covering the recess, mounted in the supporting part, and having a slot defined through the cap longitudinally; and a notch defined in the cap laterally;

an adjusting knob mounted in the supporting part and the cap, and having a mounting tube mounted through the supporting part and the cap, protruding from one of two end surfaces of the adjusting knob, and having an outer thread formed in an outer surface of the mounting tube;

an abutting element mounted inside the supporting part and the cap, mounted around the mounting tube, being capable of moving along the mounting tube, and having a mounting hole defined in a center of the abutting element, receiving the mounting tube, and having an inner thread, the inner thread formed in an inner surface of the mounting hole and engaged with the outer thread of the mounting tube;

a guiding part protruding from an outer surface of the abutting element and mounted slidably in the guiding groove; and a restricted element mounted in the abutting element, extending slidably out of the slot, and having a flange formed annularly on an outer surface of the restricted element, and abutting an outer surface of the cap; and a resilient element mounted inside the recess, wherein one of two ends of the resilient element is mounted on the abutting element, and the other end of the resilient element extends out of the notch;

a pivoting assembly mounted between the assembling part and the mounting assembly;

a rotating element mounted on the pivoting assembly, wherein the other end of the resilient element is mounted in the rotating element;

a beater holder assembly mounted on the pivoting assembly;

a chain assembly mounted on the pivoting assembly; and a foot board, wherein one of two ends of the foot board is mounted in the chain assembly, and the other end of the foot board is mounted rotatably on the main plate.

2. The drum pedal as claimed in claim 1, wherein the pivoting assembly has a shaft mounted through the assembling part and the mounting assembly, and having an attaching part extending out of the assembling part and formed in one of two ends of the shaft; and two connecting recesses defined radially in an outer wall of the shaft, and spaced apart at an interval; and a sleeve mounted rotatably on the outer wall of the shaft, and having two connecting holes radially defined in an outer surface of the sleeve and corresponding to the connecting recesses respectively, wherein the rotating element, the beater holder assembly and the chain assembly are mounted respectively on the outer surface of the sleeve.

3. The drum pedal as claimed in claim 2, wherein the assembling part has a first accommodating part defined in the assembling part;

the adjusting knob has a second accommodating part defined in the other end surface of the adjusting knob and communicating with the mounting tube;

the sleeve has two mounting grooves defined respectively in two end surfaces of the sleeve; and the pivoting assembly has a first bearing mounted inside the first accommodating part and receiving the attaching part of the shaft;

a second bearing mounted inside one of the two mounting grooves and receiving the shaft;

a third bearing mounted inside the other mounting groove and receiving the shaft;

a fourth bearing mounted between the supporting part and the cap, corresponding to the third bearing axially, and receiving the shaft;

a fifth bearing mounted inside the second accommodating part and receiving the shaft; and a retaining ring receiving the shaft, mounted between the third bearing and the fourth bearing, and abutting the third bearing and the fourth bearing respectively.

4. The drum pedal as claimed in claim 3, wherein the sleeve has an embossed part formed in the outer surface of the sleeve;

the rotating element has a through hole defined through the rotating element and receiving the sleeve;

a clamping part protruding from the rotating element; and a combining element mounted on the clamping part and abutting the other end of the resilient element;

the beater holder assembly has a beater holder mounted on the outer surface of the sleeve and having a first assembling hole defined axially through the beater holder; and a first rough surface formed inside the first assembling hole and abutting the embossed part; and a beater mounted in the beater holder; and the chain assembly has a holding base mounted on the outer surface of the sleeve and having a first assembling hole defined axially through the holding base; and a second rough surface formed inside the second recess and abutting the embossed part; and a chain, wherein one of two ends of the chain is mounted in the holding base, and the other end of the chain is mounted in the foot board.

5. A drum pedal unit comprising:

two drum pedals and each drum pedal having a base having a main plate;

two brackets protruding from the main plate and spaced apart at an interval, wherein one of the two brackets has an assembling part formed on the bracket and located away from the main plate, and the assembling part has a first accommodating part defined in the assembling part; and a mounting assembly mounted on the other bracket, located away from the main plate, and having a supporting part having a recess defined in the supporting part; and a guiding groove defined in the recess longitudinally;

a cap covering the recess, mounted in the supporting part, and having a slot defined in the cap longitudinally; and a notch defined in the cap laterally;

an adjusting knob mounted in the supporting part and the cap, and having a mounting tube, mounted through the supporting part and the cap, protruding from one of two end surfaces of the adjusting knob, and having an outer thread formed in an outer surface of the mounting tube; and a second accommodating part defined in the other end surface of the adjusting knob and communicating with the mounting tube;

an abutting element mounted inside the supporting part and the cap, mounted around the mounting tube, being capable of moving along the mounting tube, and having a mounting hole defined in a center of the abutting element, receiving the mounting tube, and having an inner thread, the inner thread formed in an inner surface of the mounting hole and engaged with the outer thread of the mounting tube;

a guiding part protruding from an outer surface of the abutting element and mounted slidably in the guiding groove; and a restricted element mounted in the abutting element, extending slidably out of the slot, and having a flange formed annularly on an outer surface of the restricted element and abutting an outer surface of the cap; and a resilient element mounted inside the recess, wherein one of two ends of the resilient element is mounted on the abutting element, and the other end of the resilient element extends out of the notch;

a pivoting assembly mounted between the assembling part and the mounting assembly, and having a shaft mounted through the assembling part and the mounting assembly, and having an attaching part extending out of the assembling part and formed in one of two ends of the shaft; and two connecting recesses defined radially in an outer wall of the shaft and spaced apart at an interval;

a sleeve mounted rotatably on the outer wall of the shaft and having two connecting holes defined radially in an outer surface of the sleeve and corresponding to the connecting recesses respectively; and two mounting grooves defined respectively in two end surfaces of the sleeve;

a first bearing mounted inside the first accommodating part and receiving the attaching part of the shaft;

a second bearing mounted inside one of the two mounting grooves and receiving the shaft;

a third bearing mounted inside the other mounting groove and receiving the shaft;

a fourth bearing mounted between the supporting part and the cap, corresponding to the third bearing axially, and receiving the shaft;

a fifth bearing mounted inside the second accommodating part and receiving the shaft; and a retaining ring receiving the shaft, mounted between the third bearing and the fourth bearing, and abutting the third bearing and the fourth bearing respectively;

a rotating element mounted on the outer surface of the sleeve, wherein the other end of the resilient element is mounted in the rotating element;

a beater holder assembly mounted on the outer surface of the sleeve;

a chain assembly mounted on the outer surface of the sleeve; and a foot board, wherein one of two ends of the foot board is mounted in the chain assembly, and the other end of the foot board is mounted rotatably on the main plate, wherein one of the drum pedals has two connecting elements, each connecting element mounted in the connecting hole and the connecting recess, wherein the sleeve is mounted firmly in the shaft, and the attaching part of the shaft extends out of the adjusting knob; and a minor sleeve mounted firmly on the outer surface of the shaft of the other drum pedal, and having multiple first fastening elements mounted through the minor sleeve and abutting the shaft, wherein the beater holder assembly of the drum pedal that has the connecting elements is mounted on an outer surface of the minor sleeve; and a coupling assembly connecting the drum pedals, and having two universal joints mounted on two ends of the coupling assembly, mounted in the shafts of the drum pedals, and each one of the universal joints having an attaching recess receiving the attaching part of the shaft.

6. The drum pedal unit as claimed in claim 5, wherein the coupling assembly has a connecting sleeve being hollow;

two sticks mounted in two ends of the connecting sleeve, wherein the universal joints are mounted in the sticks respectively; and multiple second fastening elements spaced apart at intervals, mounted through the coupling assembly, and abutting the sticks.

* * * * *